US006862823B2

(12) United States Patent
deCarteret

(10) Patent No.: US 6,862,823 B2
(45) Date of Patent: Mar. 8, 2005

(54) QUILT DESIGN HOLDING DEVICE AND METHOD

(76) Inventor: Janet C. deCarteret, 1004 141 Pl. NE., Bellevue, WA (US) 98007

( * ) Notice: Subject to any disclaimer, the term of this patent is extended or adjusted under 35 U.S.C. 154(b) by 249 days.

(21) Appl. No.: 10/246,339

(22) Filed: Sep. 17, 2002

(65) Prior Publication Data

US 2003/0066216 A1 Apr. 10, 2003

Related U.S. Application Data

(60) Provisional application No. 60/325,433, filed on Sep. 26, 2001.

(51) Int. Cl.[7] ..... D06C 3/00
(52) U.S. Cl. ..... 38/102
(58) Field of Search ..... 38/102, 102.2, 38/102.91; 5/502, 482; 33/1 B, 1 AA, 11, 12, 562; 428/40.1, 41.7, 41.8, 41.9, 42.1; 156/97

(56) References Cited

U.S. PATENT DOCUMENTS 4,223,055 A * 9/1980 Castelluzzo et al. ..... 428/41.9
4,640,529 A * 2/1987 Katz ..... 281/5
4,748,044 A * 5/1988 Fottinger et al. ..... 427/501
4,900,604 A * 2/1990 Martinez et al. ..... 428/79
4,949,415 A * 8/1990 Selga ..... 5/502
4,992,121 A 2/1991 Rubino ..... 428/913.3
5,665,448 A 9/1997 Graham et al. ..... 428/79
5,791,062 A * 8/1998 Walker ..... 33/563
6,106,760 A 8/2000 Graham et al. ..... 264/484
6,159,325 A 12/2000 Graham et al. ..... 156/250
6,503,591 B2 * 1/2003 Kuo et al. ..... 428/41.9

* cited by examiner

*Primary Examiner*—Ismael Izaguirre
(74) *Attorney, Agent, or Firm*—Dean A. Craine

(57) ABSTRACT

A quilt design holding device comprising a non-woven fabric sheet with top and bottom surfaces both impregnated with a non-transferable dry tack adhesive. Printed on the front surface of the fabric sheet is a grid pattern made of perpendicularly aligned first and second straight gridlines spaced one-inch apart with a one-inch margin along the top, bottom, and side edges. Inches and feet are labeled in the one-inch margin along the top, bottom, and side edges of the grid. The top and bottom edges and two side edges of the grid are marked with indicia at ½-inch, ¼-inch, and ⅛-inch intervals. Optional diagonal guidelines are printed on the grid pattern to help temporarily align selected pieces of fabric used to make a quilt on the device for viewing.

8 Claims, 4 Drawing Sheets

QUILT DESIGN HOLDING DEVICE AND METHOD

This is a utility patent application based on a provisional patent application (Ser. No. 60/325,433) filed on Sep. 26, 2001.

BACKGROUND OF THE INVENTION

1. Field of the Invention

This invention pertains to quilt construction and, more particularly, to devices which aid in quilt design and construction.

2. Description of the Related Art

Making quilts from small patches of fabric of different colors and prints, arranged to create pictures or patterns, is well known. In the early days of quilting, the pieces of fabric were cut by hand using scissors, and sewn together by hand using needle and thread. In recent times, most quilting is done using sewing machines and the cutting and joining of the fabric pieces has been simplified somewhat using various templates, rotary cutters, cutting mats, etc.

The quilt design that appears on the top layer of a quilt is generally produced in one of three ways. The quilt top may be made of a single fabric and quilting stitches form the design. More commonly, the top is appliqued, wherein pieces are cut from various cloths and stitched onto a background fabric, making a picture or pattern. The quilt design may also be produced in a process called patchwork, wherein units of cloth are sewn together edge to edge to form a fabric with geometric patterns. Quilt designs are often intricate and exact. A single quilt frequently involves multiple fabric colors and prints and requires hundreds of patches of cloth.

Quilt makers, whether they are working with a traditional design or creating their own design, generally prepare design plans, or mock-up blocks, to see how individual fabrics work as patches in relation to each other. The quilt maker creates mock-up blocks of patches of the basic unit of the quilt construction, usually a square, using samples of fabrics in various colors and prints. The mock-up blocks may be temporarily attached, using pins or adhesive spray, to a fabric-covered board. Once attached to the fabric-covered board, the quilt maker may want to temporarily hang the board on a vertical surface so that the proposed quilt design may be viewed from a distance. The quilt maker may also want to transport the board with the proposed quilt design attached thereto to a quilting class for others to review.

Using a fabric-covered board for temporarily displaying mock-up blocks is unsatisfactory for several reasons. First, the act of mechanically attaching the mock-up blocks to the board makes it more difficult to rearrange the mock-up blocks. Second, pins and tacks may interfere with the appearance of the design. Third, boards are not well suited for storing or transporting proposed quilt designs. Fourth, hardware, such as hooks, is required to temporarily attach the board to a suitable wall or door surface and this may be undesirable to the homeowner. Lastly, the mock-up blocks may fall or move on the board when the board is moved or transported to a new location.

What is needed is a quilt design holding device that can be used on either a horizontal or vertical rigid support surface that temporarily and securely holds a plurality of mock-up blocks for viewing without the use of pins or adhesives, that does not require modification or the use of brackets, hooks, or pins to attach the device to the support surface, and that may be folded into a compact configuration for storage or easy transport and then unfolded so that the mock-up blocks maintain their original positions on the device.

SUMMARY OF THE INVENTION

It is an object of the present invention to provide a quilt design holding device used to temporarily hold a plurality of mock-up blocks used when constructing quilts.

It is another object of the invention to provide such a device that also acts as a display device for temporarily holding a plurality of proposed mock-up blocks.

It is another object of the present invention to provide such a quilt design holding device that, while temporarily holding the mock-up blocks, can easily be used on either a horizontal or vertical support surface without causing damage to, or modification of, the support surface.

It is a further object of the present invention to provide a quilt design holding device that can be folded into a compact configuration and hold the proposed mock-up blocks in their relative positions for later viewing.

These and other objects of the invention which will become apparent are met by the quilt design holding device disclosed herein comprising a flexible, thin, light-weight, non-woven fabric sheet which is impregnated with a non-transferable dry tacky adhesive on its front and back surfaces. The fabric sheet is a square or rectangle structure with parallel top and bottom edges and parallel right and left side edges.

Printed on the front surface is an optional grid pattern made of perpendicularly aligned gridlines spaced one-inch apart. Printed along the gridlines, parallel to the top and bottom edges and right and left side edges are inch and foot indicators and optional ½-inch to ⅛-inch markings. Also, printed at the upper left and lower right corners of the grid pattern are two parallel diagonal gridlines. In the preferred embodiment, the two diagonal gridlines are aligned at 45-degree angles to the top and bottom edges. A third diagonal gridline, aligned perpendicular to the two diagonal gridlines, is printed on the front surface from the top left-hand corner to the lower right-hand corner.

The fabric sheet is sufficiently fibrous and lightweight and the adhesives are sufficiently tacky so that the fabric sheet may be held in a vertical position on a wall, door, or window with a plurality of mock-up blocks adhesively attached to its front surface. The tacky adhesive is a latex acrylic adhesive so that the adhesive retains its adhesiveness when the fabric sheet is washed with lukewarm water. The adhesive also does not leave a residue on the support surface.

An optional non-sticking intermediate sheet is included to facilitate rolling or folding the quilt design holding device.

Using the above-described device, a method of temporarily displaying a portion of a quilt is also provided.

DESCRIPTION OF THE PREFERRED EMBODIMENT(S)

Figure 1:
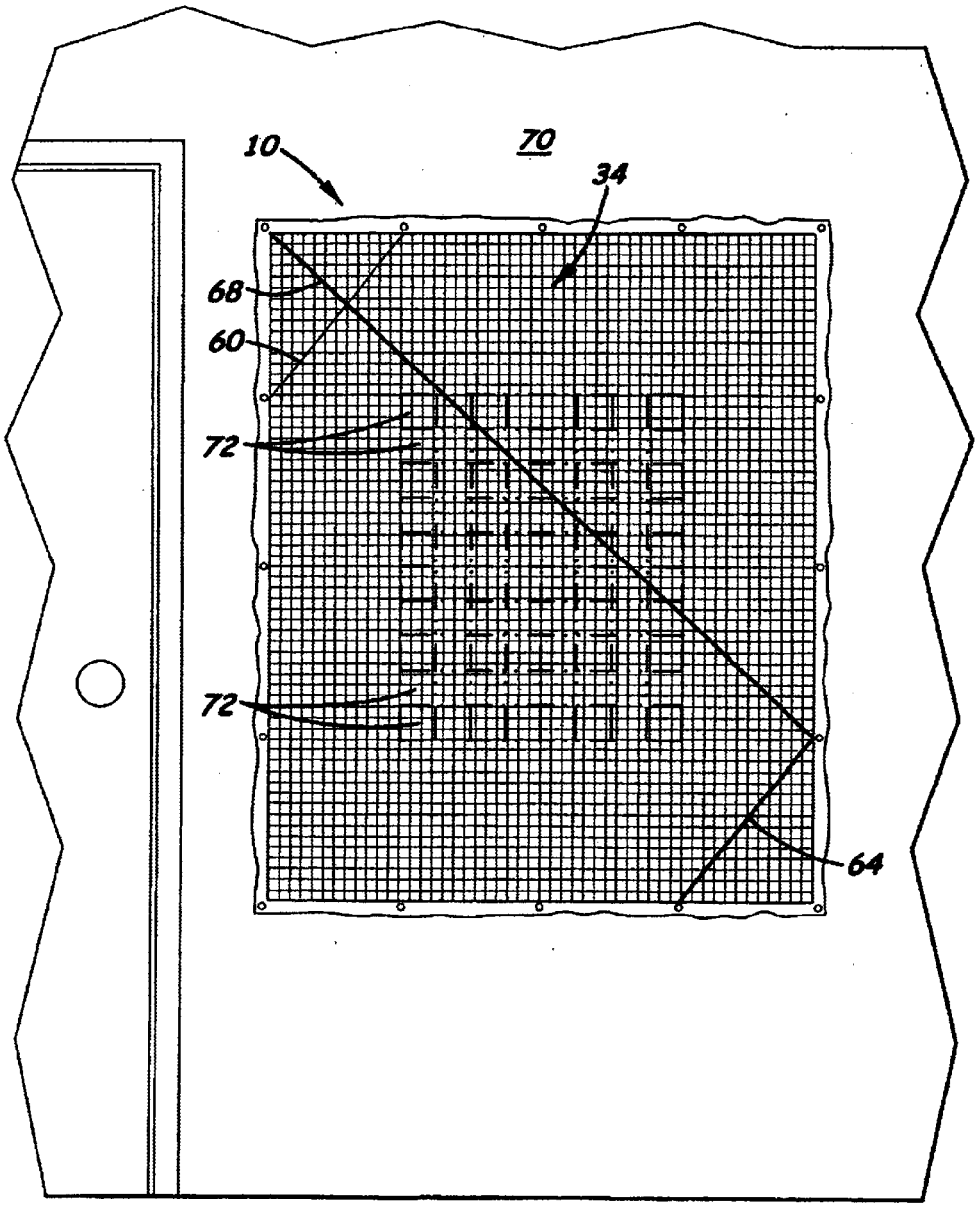
FIG. 1 is a front elevational view of the quilt design holding device disclosed herein shown attached to a wall surface.
Figure 2:
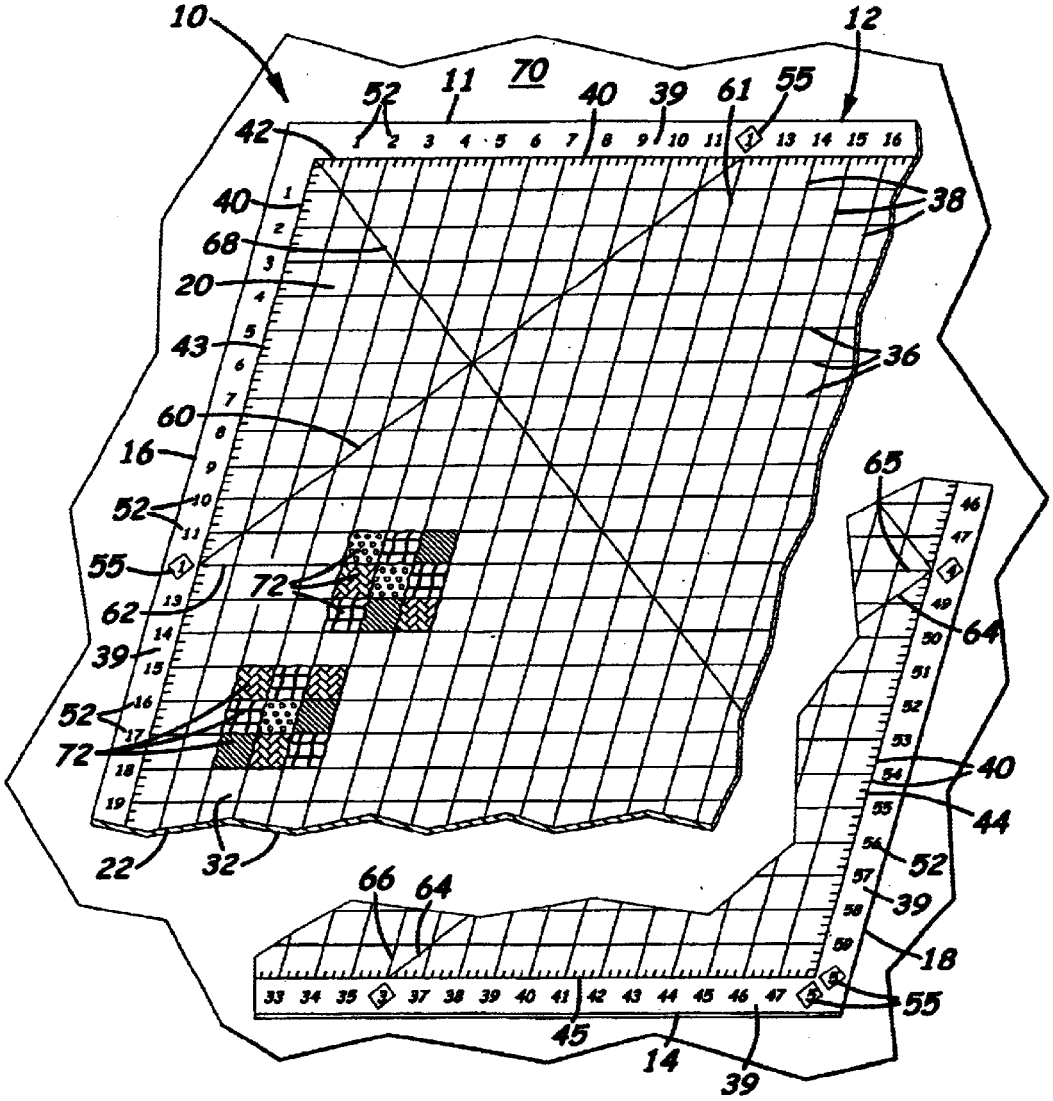
FIG. 2 is a perspective view of the quilt design holding device.

Referring to the accompanying FIGS. 1–4, there is shown and described a quilt design holding device 10 comprising a rectangular non-woven fabric sheet 12 which includes front and back surfaces 20, 22, respectively, impregnated with or covered with a non-transferable dry tack adhesive 32. The quilt design holding device 10 has straight top and bottom edges 11, 14, respectively, disposed parallel to each other. The left and right side edges 16, 18, are disposed parallel to each other and perpendicular to the top and bottom edges 11, 14 respectivley. In the preferred embodiment, the fabric sheet 12 is approximately fifty inches in width and sixty-two inches in length. In the preferred embodiment, the sheet is made of polyester felt, approximately 2.5 to 4 ounces per square yard, and is coated on its front and back surfaces 20, 22, respectfully, with a latex acrylic adhesive 32, similar to rug holding products sold under the trademarks CARPET GRIPPER, WUNDER-LOCK, and RUG-LOCK by Home Safety Products of Atlanta, Ga., WunderGrip, Inc. of Mount Laurel, N.J., and Rug-Hold NSC, Inc. of Dalton, Ga., respectively. The latex acrylic adhesive is particularly desirable, as it does not leave a residue on walls, doors, or windows and retains its adhesiveness when washed in warm water.

The front surface 20 is marked with an optional grid pattern 34 of perpendicularly aligned horizontal and vertical gridlines 36, 38, respectively, spaced one-inch apart. The grid pattern 34 is printed on the front surface 20 of sheet 12, with a one-inch margin 39 along the top, bottom, and side edges 11, 14, 16, 18, respectively. In the embodiment shown, the grid pattern 34 measures approximately forty-eight inches in width and sixty inches in length. It should be understood that the fabric sheet 12 could also be manufactured in 3×3-foot, 4×6-foot, or 6×6-foot sizes. It should also be understood that the horizontal and vertical gridlines 36, 38 could be spaced two to twelve inches apart.

The top and bottom gridlines 42, 45, the left-edge gridline 43 and the right-edge gridline 44 are marked with optional ⅛-inch distance indicators 40. Indicia 52, 55 indicting inches and feet, respectively, may be printed in the margins 39 adjacent to the top, bottom, left-edge, and right-edge gridlines 42, 45, 43, 44, respectively.

An optional diagonal guideline 60 is printed on the grid pattern 34 from the intersection between top gridline 42 and the twelve-inch vertical gridline 61 to the intersection between the left-edge gridline 43 and the twelve-inch horizontal gridline 62. An optional second diagonal guideline 64, aligned parallel to the guideline 60, is printed on the grid pattern 34 from the intersection between the right gridline 44 and the 48-inch horizontal gridline 65 to the intersection between the bottom gridline 45 and the 36-inch vertical gridline 66. An optional third diagonal guideline 68, perpendicularly aligned with guideline 60, is printed on the grid pattern 34 from the top left-hand corner of the grid pattern 34 to the intersection between the 48-inch horizontal gridline 65 and the right edge gridline 44.

Figure 3:
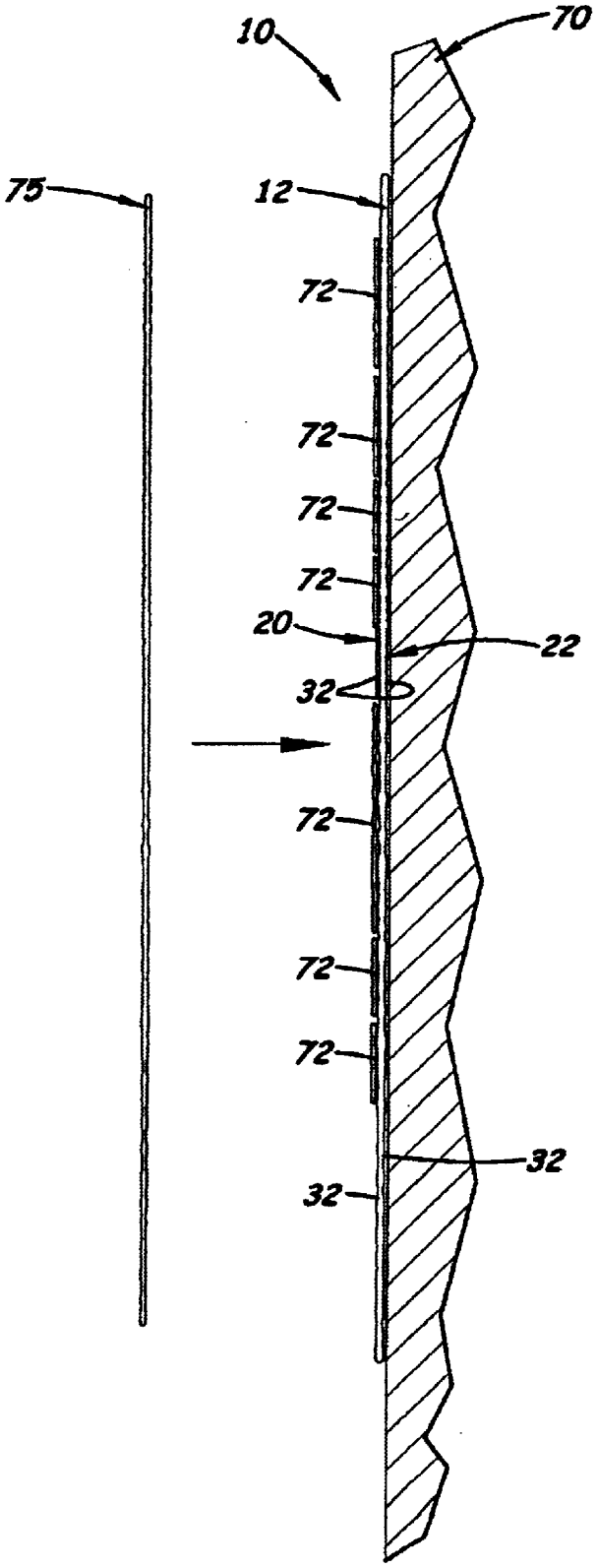
FIG. 3 is a side view of the quilt design holding device shown in FIG. 1 with an optional protective sheet being placed thereover.
Figure 4:
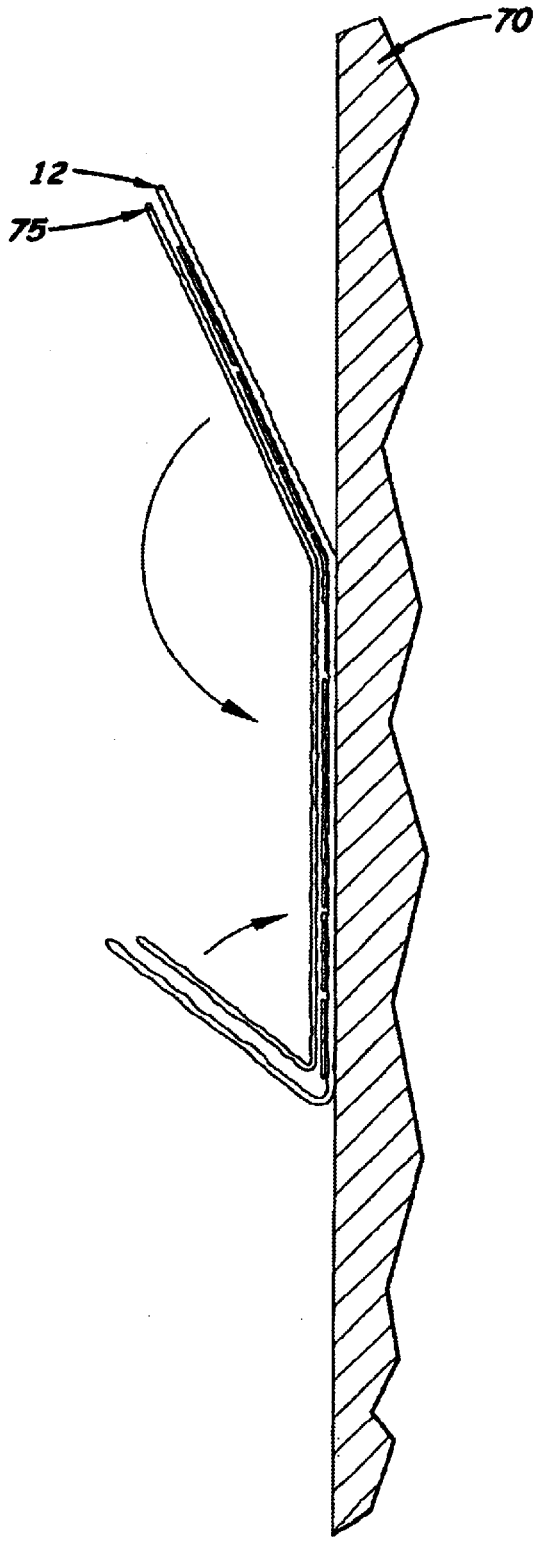
FIG. 4 is a side view of the quilt design holding device shown it being folded.

As shown in FIGS. 3 and 4, an optional non-sticking intermediate sheet 75, approximately the same size as the sheet 12, is included to facilitate rolling or folding the quilt design holding device 10.

In use, the quilt maker unfolds the device 10 and attaches it to a horizontal surface or a vertical surface such as a door or wall 70. The quilt maker then creates mock-up blocks 72 of the basic unit of the quilt construction using samples of fabrics in various colors and prints, sticking the mock-up blocks 72 directly to the dry-tack adhesive 32 of the front surface 20. The quilt maker can then view the mock-up blocks 72 from a distance to determine his or her preference of the various design elements. Once the design elements are chosen, the representative mock-up block or blocks 72 will serve as reference patterns throughout the quilt-making project. If the quilt maker chooses to move the quilt design holding device 10 to a new location, she can remove the quilt design holding device 10 easily from the door or wall 70 by simply loosening and pulling the dry-tack adhesive 32 on the back surface 22 of the quilt design holding device 10 from the door or wall 70 surface. The optional intermediate sheet 75 can then be placed over the front surface 20 of the quilt design holding device 10 and mock-up blocks 72 so that the quilt design holding device 10 can be folded or rolled for transport without sticking to itself. The quilt maker can easily reapply the quilt design holding device 10 to a wall or door surface 70.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A quilt design holding device, comprising:

a. fabric sheet with top and bottom edges, first and second side edges, and front and a back surfaces;

b. a grid of perpendicular lines printed on said front surface, said grid of perpendicular lines are spaced one to twelve inches apart; and, c. a non-transferable, dry tacky adhesive applied to said front surface and said back surface of said fabric sheet.

2. The quilt design holding device, as recited in claim 1, further including inch indicators located along said top, bottom, first side, and second side edges.

3. The quilt design holding device, as recited in claim 2, further including at least two 45-degree diagonal guidelines printed on said front surface of said fabric sheet.

4. The quilt design holding device, as recited in claim 3, further including a third diagonal guideline printed on said front surface of said fabric sheet perpendicularly aligned with said 45-degree diagonal guidelines.

5. The quilt design holding device, as recited in claim 4, further including a removable non-sticking intermediate sheet disposed over said dry tacky adhesive.

6. The quilt design holding device, as recited in claim 1, wherein said fabric sheet is made of polyester felt.

7. A quilt design holding device, comprising;

a. a fabric sheet with top and bottom edges, first and second side edges, and front and a back surface;

b. a grid of perpendicular lines printed on said front surface, said grid of perpendicular lines are spaced one to twelve inches apart; and, c. a non-transferable, dry tacky latex acrylic adhesive applied to said front surface and said back surface of said fabric sheet.

8. A method of temporarily displaying a quilt pattern, comprising the following steps:

a. selecting a flat support surface;

b. selecting a quilt design holding device which includes a non-woven fabric sheet with front and back surfaces and non-transferable, dry tacky adhesives applied to said front and back surfaces;

c. applying said fabric sheet to said flat support surface;

d. selecting pieces of fabric for a desired quilt pattern to display said quilt pattern when disposed over said support surface; and, e. attaching said pieces of fabric in a desired arrangement to said front surface of said fabric sheet.

* * * * *